US010863828B2

(12) United States Patent
Kufel

(10) Patent No.: US 10,863,828 B2
(45) Date of Patent: Dec. 15, 2020

(54) BENCH WITH A RETRACTABLE FOOTREST

(71) Applicant: Gary W Kufel, Goodlettsville, TN (US)

(72) Inventor: Gary W Kufel, Goodlettsville, TN (US)

( * ) Notice: Subject to any disclaimer, the term of this patent is extended or adjusted under 35 U.S.C. 154(b) by 87 days.

(21) Appl. No.: 16/219,538

(22) Filed: Dec. 13, 2018

(65) Prior Publication Data

US 2019/0174924 A1 Jun. 13, 2019

Related U.S. Application Data

(60) Provisional application No. 62/598,346, filed on Dec. 13, 2017.

(51) Int. Cl.
*A47C 7/50* (2006.01)
*A47C 11/00* (2006.01)

(52) U.S. Cl.
CPC ..... *A47C 7/5062* (2018.08); *A47C 11/00* (2013.01)

(58) Field of Classification Search
CPC ..... A47C 7/5062; A47C 11/00; A47C 7/506
USPC ..... 297/423.2, 56
See application file for complete search history.

(56) References Cited

U.S. PATENT DOCUMENTS 841,022 A * 1/1907 Lahm ..... A47C 1/035 297/27
3,767,190 A * 10/1973 Biggerstaff ..... A47C 1/034 482/142
4,322,109 A * 3/1982 Thebaud ..... A47C 4/022 108/118
5,211,443 A * 5/1993 Kelly ..... A47C 1/14 297/31
6,523,890 B1 * 2/2003 Anderson ..... A47B 13/04 297/118

FOREIGN PATENT DOCUMENTS

EP 0211407 A2 * 2/1987 ..... A47C 4/22

* cited by examiner

*Primary Examiner* — Milton Nelson, Jr.

(57) ABSTRACT

A bench with a retractable footrest is an apparatus that compactly stores and effectively conceals a footrest. The apparatus includes a seat panel, a back panel, a first frame, a second frame, a retractable footrest, a storage receptacle, and a slider mechanism. The seat panel and the back panel upholds the user while sitting on the apparatus. The first frame and the second frame, together, connects the seat panel and the back panel. The first frame and the second frame allow the seat panel and the back panel to open and close with each other. The retractable footrest upholds the calves, and consequently, the feet of the user, alleviating the stress on the knees of the user. The storage receptacle connects the retractable footrest with the seat panel and houses the retractable footrest. The slider mechanism allows a user to retract and extend the retractable footrest within the storage receptacle.

13 Claims, 6 Drawing Sheets

BENCH WITH A RETRACTABLE FOOTREST

The current application claims a priority to the U.S. Provisional Patent application Ser. No. 62/598,346 filed on Dec. 13, 2017.

FIELD OF THE INVENTION

The present invention relates generally to benches. More specifically, the present invention is a bench with a retractable footrest.

BACKGROUND OF THE INVENTION

The average person spends the vast majority of his or her time sitting. The sedentary lifestyles enabled from computer convenience and similar technologies enable a user to be productive without physical exertion, thus focusing their energy on work and mental exertion. To this end, a variety of seats have been created. Several such seats use sturdy frames in various configurations to support different cushions. These frames often contour to the body, providing ergonomic support for the user and thus enhancing user comfort.

However, such seats are often limited in their functionality and comfort options. The user's legs may dangle uncomfortably below the seat, which places strain on the user's knees. Even when a user's feet contact the ground, the user may experience discomfort. Variation of knee and hip angles is essential to joint health, and sitting in one position for extended periods of time can result in deterioration of protective ligaments and cartilage. This ultimately leads to knee pain, and can even generate injuries if left untreated or unaddressed. To this end, several seats with lifting leg supports have been invented. These seats provide relief from chronic knee pain, and by lifting the leg angle also remove strain from the hip area. However, such seats are typically one-person seats that are not conducive to accommodating multiple people. What is needed is a seat, chair, or sitting device that enables multiple users to sit comfortably at the same time. Further desirable is a wide seat with an adjustable leg or foot rest.

The present invention addresses these issues. The present invention has a contoured seat and a contoured back, both made of panels resting on sturdy supports. An armrest enables further comfort for the sitting user. A sliding button enables the user to toggle the lifted or not lifted status of the foot rest. This allows a user to reach conveniently to the user's side to lift or lower the user's feet. The other section of the seat is not affected by the closed or opened foot rest, and is free to comfortably seat a person who does not want their legs lifted.

DETAILED DESCRIPTION OF THE INVENTION

Figure 1:
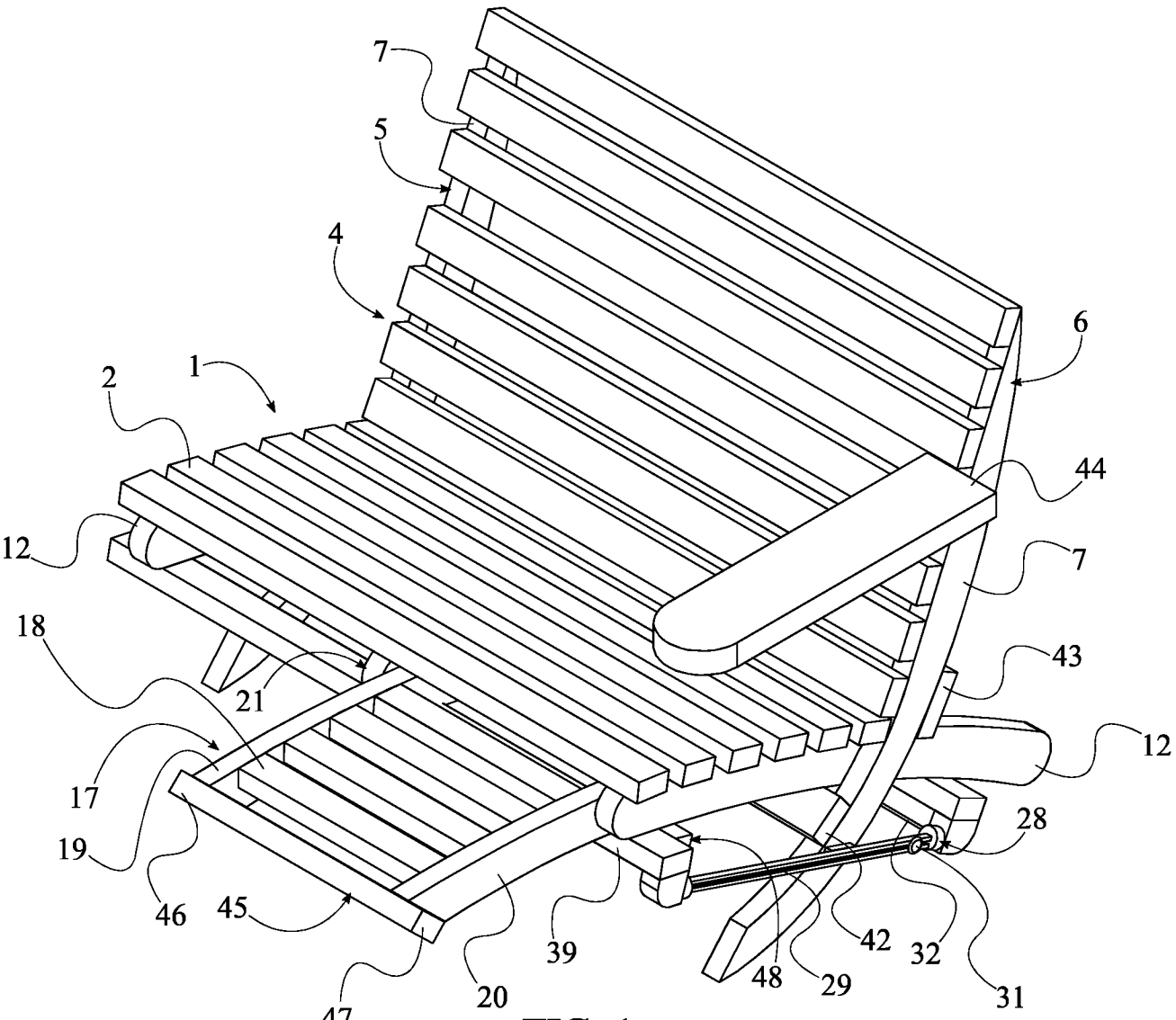
FIG. 1 is a perspective view of the present invention with the retractable footrest extended from the storage receptacle.

All illustrations of the drawings are for the purpose of describing selected versions of the present invention and are not intended to limit the scope of the present invention.

The present invention is a bench with a retractable footrest 17. The present invention allows a user to easily extend and retract a footrest compactly stored within the bench. The present invention may standalone, as well as be attached to a swing. The present invention allows the user to comfortably sit on the bench without the angle between the seat and the backrest. In order for the present invention to compactly store a footrest, the present invention comprises a seat panel 1, a back panel 4, a first frame 5, a second frame 6, a retractable footrest 17, a storage receptacle 21, and a slider mechanism 28, seen in FIG. 1. The seat panel 1 upholds a user while the user is in a sitting position. The back panel 4 supports the back of a user while the user is in the sitting position. Both the seat panel 1 and the back panel 4 preferably comprise a plurality of wooden slats that are distributed across the first frame 5 and the second frame 6, respectively. The first frame 5 and the second frame 6 connect and stabilizes the seat panel 1 and the back panel 4. The first frame 5 and the second frame 6 each comprises a first elongated bar 7 and a second elongated bar 12. the first elongated bar 7 attaches the back panel 4 to the seat panel 1, and the second elongated bar 12 attaches the seat panel 1 to the back panel 4. The retractable footrest 17 uplifts the legs of a user such that the calves of the user are parallel with the thighs of the user, alleviating stress from the knees of the user. The storage receptacle 21 houses the retractable footrest 17 and allows the retractable footrest 17 to extend from within the present invention. The slider mechanism 28 allows a user to easily retract and extend the retractable footrest 17 while in the sitting position. More specifically, the user may access the retractable footrest 17 without having to bend over and reach for the retractable footrest 17.

Figure 2:
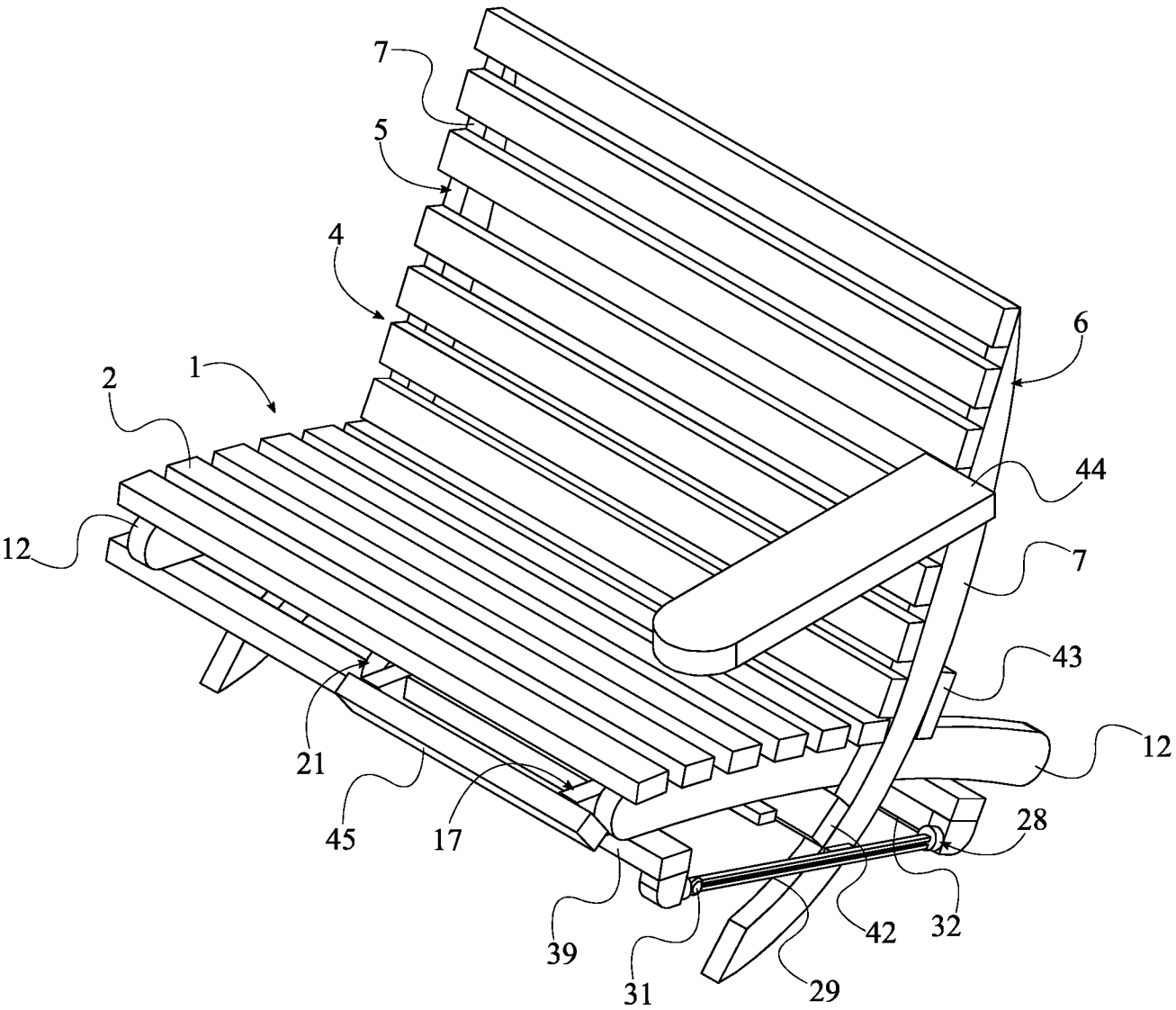
FIG. 2 is a perspective view of the present invention with the retractable footrest retracted within the storage receptacle.

The overall configuration of the present invention of the aforementioned components allows the present invention to ergonomically support the user while in a sitting position. The entire body of the user is supported with the present invention as the seat panel 1 is positioned adjacent the back panel 4, seen in FIG. 1, FIG. 2, and FIG. 3. The seat panel 1 is connected in between the second elongated bar 12 of the first frame 5 and the second elongated bar 12 of the second frame 6. Similarly, the back panel 4 is connected in between the first elongated bar 7 of the first frame 5 and the first elongated bar 7 of the second frame 6. This arrangement aligns the seat panel 1 with the back panel 4 such that the seat panel 1 an inner surface of the seat panel 1 and an inner surface of the back panel 4 remain parallel with each other whether in an open configuration and in an open configuration. The present invention is easily stored and transportable as the first elongated bar 7 and the second elongated bar 12 are hingedly coupled at a rotational central axis 41. The storage receptacle 21 traverses across a second surface 3 of the seat panel 1, and the second surface 3 is positioned opposite a first surface 2 of the seat panel 1, across the seat panel 1. The first surface 2 of the seat panel 1 is positioned adjacent the back panel 4 and is the inner surface of the seat panel 1 that comes into contact with the user. The storage receptacle 21 is mounted to the second elongated bar 12 of the second frame 6 and the second surface 3 of the seat panel 1, thereby positioning the retractable footrest 17 directly beneath the calves of the user. Moreover, the slider mechanism 28 is operatively coupled with the retractable footrest 17 and the storage receptacle 21, wherein the slider mechanism 28 enables the retractable footrest 17 to slide into and out of the storage receptacle 21, as seen in FIG. 1 and FIG. 2.

Figure 3:
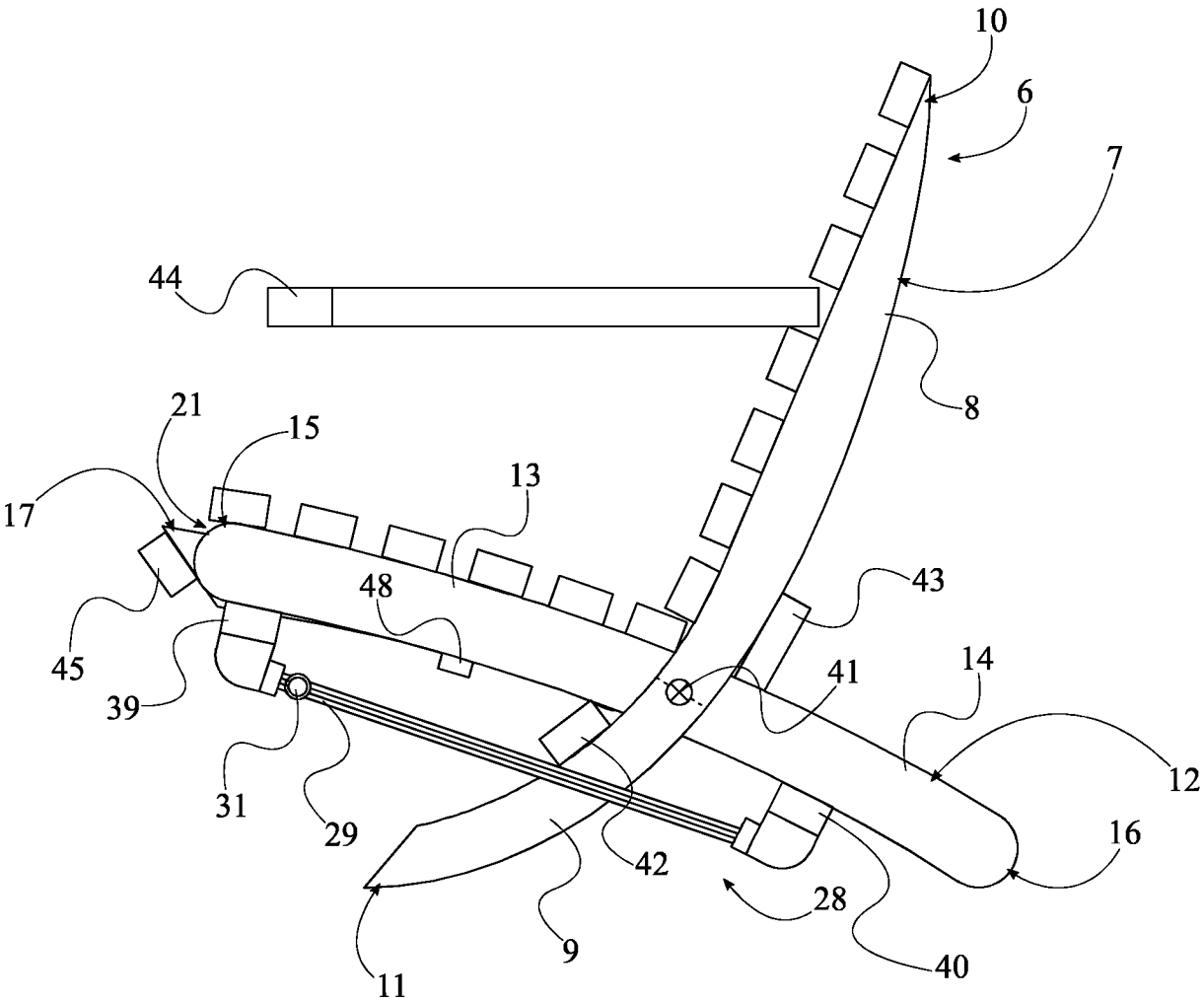
FIG. 3 is a side view of the present invention with the retractable footrest retracted within the storage receptacle.

The present invention is preferably standalone as the first elongated bar 7 comprises a first panel-supporting portion 8 and a first leg portion 9, and the second elongated bar 12 comprises a second panel-supporting portion 13 and a second leg portion 14, as seen in FIG. 3. The first panel-supporting portion 8 connects the back panel 4 with the seat panel 1 through the second elongated bar 12. The second panel-supporting portion 13 connects the seat panel 1 with the back panel 4 through the first elongated bar 7. The first leg portion 9 and the second leg portion 14 uplifts and offsets the seat panel 1, and consequently the back panel 4, above the ground. The first panel-supporting portion 8 is positioned adjacent a first end 10 of the first elongated bar 7, and the first leg portion 9 is positioned adjacent a second end 11 of the first elongated bar 7. More specifically, the first end 10 is positioned opposite the second end 11 of the first elongated bar 7, wherein the second end 11 presses against the ground. In the preferred embodiment of the present invention, the first leg portion 9 is oriented away from the back panel 4. Similarly, the second panel-supporting portion 13 is positioned adjacent a third end 15 of the second elongated bar 12, and the second leg portion 14 is positioned adjacent a fourth end 16 of the second elongated bar 12. More specifically, the third end 15 is positioned opposite the fourth end 16 of the second elongated bar 12. In the preferred embodiment of the present invention, the second leg portion 14 is oriented away from the back panel 4. In order for the first elongated bar 7 and the second elongated bar 12 to both uphold and balance the seat panel 1, as well as the back panel 4, above the ground, the rotational central axis 41 traverses through the first elongated bar 7, between the first panel-supporting portion 8 and the first leg portion 9, and the second elongated bar 12, between the second panel-supporting portion 13 and the second leg portion 14.

As shown in FIG. 1, FIG. 2, FIG. 3, and FIG. 4, the present invention further supports the body of a user while in a sitting position, as the preferred embodiment of the present invention comprises an armrest 44. The armrest 44 uplifts a corresponding arm of the user. In order to comfortably support the user, the first elongated bar 7 of the second frame 6 is terminally fixed to the armrest 44, and the armrest 44 is oriented towards the seat panel 1. In alternate embodiments of the present invention, a secondary armrest 44 may be fixed to the first elongated bar 7 of the first frame 5.

In order to preserve a desired angle between the seat panel 1 and the back panel 4, the present invention comprises a first stopper bar 42 and a second stopper bar 43, seen in FIG. 1, FIG. 2, FIG. 3, and FIG. 4. The second stopper upholds the seat panel 1 against the second elongated bar 12 and prevents the seat panel 1 from traversing further along the first elongated panel towards the second end 11 of the first elongated panel. The first stopper presses against the second elongated bar 12 and prevents the back panel 4 from traversing further along the second elongated panel towards the fourth end 16 of the second elongated panel. The desired angle is defined by the position of the first stopper bar 42 and the second stopper bar 43 as the rotational central axis 41 is positioned in between a first end 10 and a second end 11 of the first elongated bar 7. The first stopper bar 42 and the second stopper bar 43 traverses from the first frame 5 to the second frame 6, effectively supporting the seat panel 1, the back panel 4, and the weight of the user. The hinged connection between the first elongated bar 7 and the second elongated bar 12 is preserved as the first stopper bar 42 and the second stopper bar 43 is fixed to the first elongated bar 7 of the first frame 5 and the first elongated bar 7 of the second frame 6. More specifically, the first stopper bar 42 is positioned in between the rotational central axis and the second end 11, and the second stopper bar 43 is positioned between the rotational central axis and the first end 10.

Figure 4:
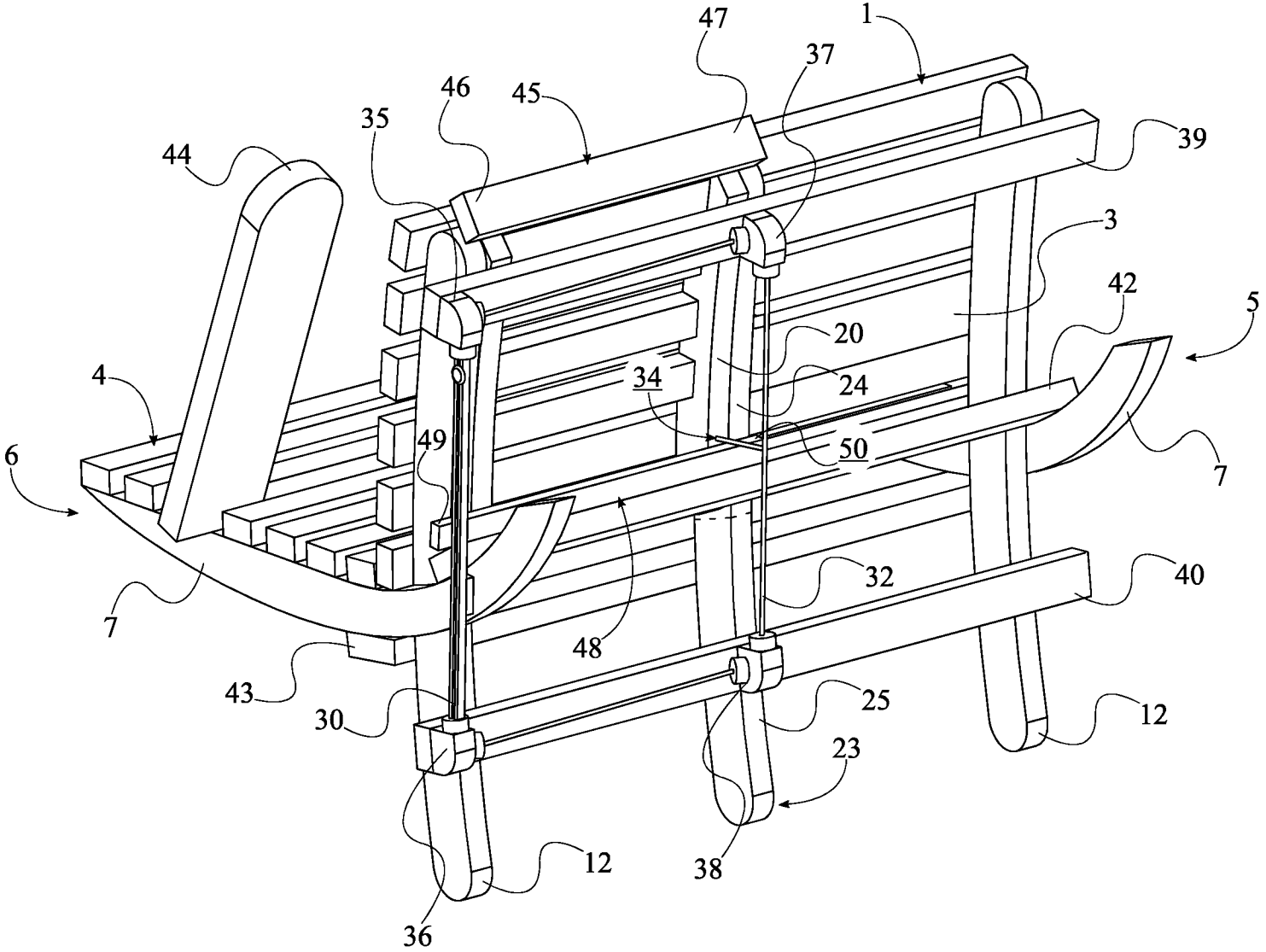
FIG. 4 is a bottom perspective view of the present invention with the retractable footrest retracted within the storage receptacle.
Figure 5:
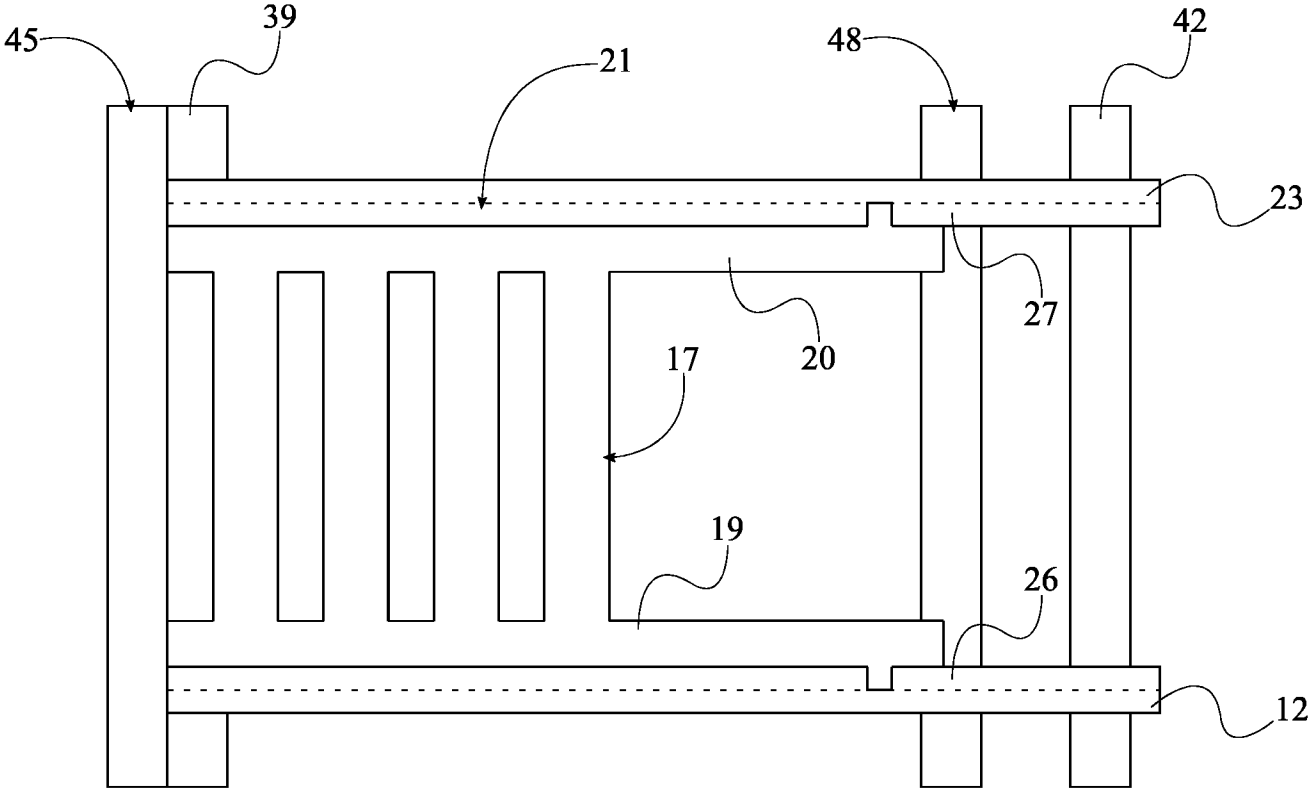
FIG. 5 is a top schematic view of the retractable footrest retracted within the storage receptacle.
Figure 6:
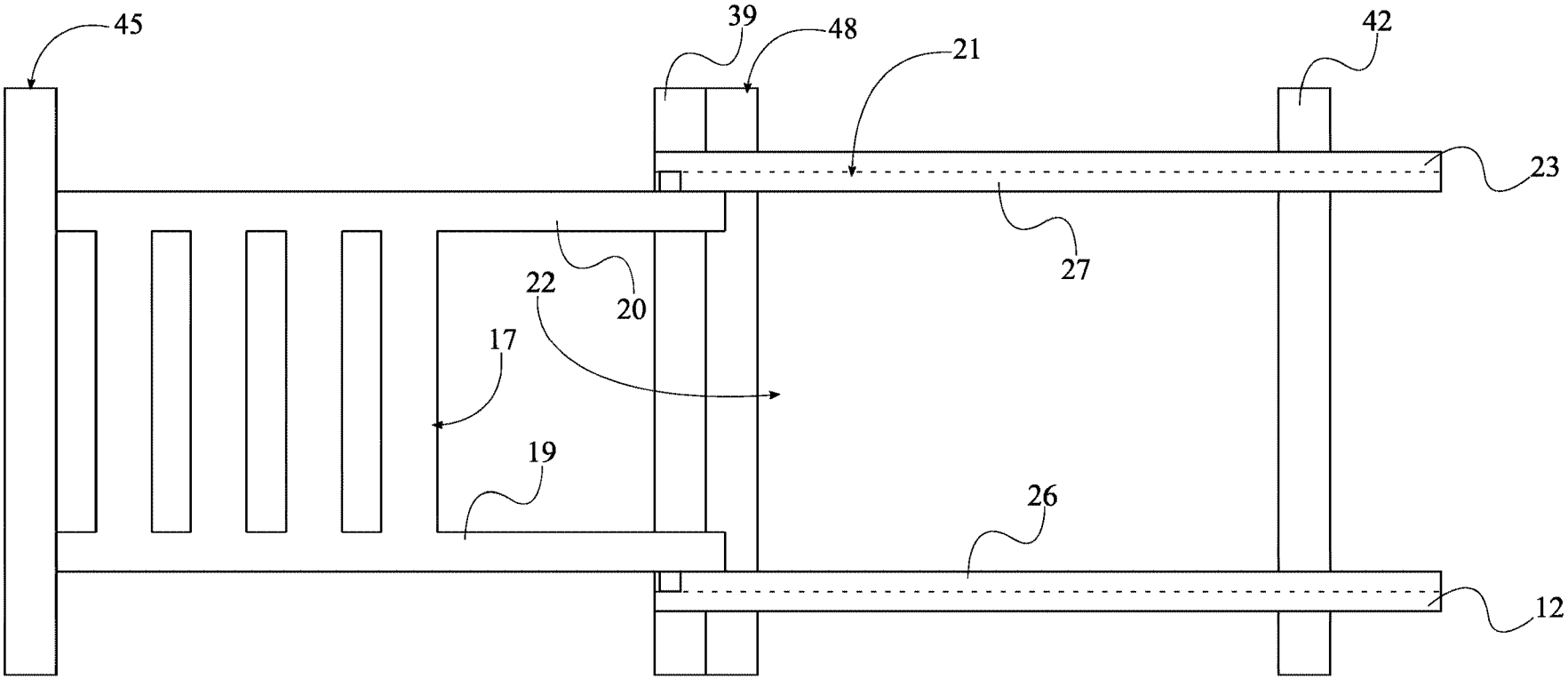
FIG. 6 is a top schematic view of the retractable footrest extended from the storage receptacle.

The retractable footrest 17 is able to freely slide within the storage receptacle 21 as the retractable footrest 17 comprises a footrest panel 18, a third elongated bar 19, and a fourth elongated bar 20, seen in FIG. 4, FIG. 5, and FIG. 6. Furthermore, the storage receptacle 21 comprises a supportive elongated bar 23, a first track 26, and a second track 27. The calves, as well as feet, are supported and upheld by the footrest panel 18. The third elongated bar 19 and the fourth elongated bar 20 connects the footrest panel 18 to the first track 26 and the second track 27, respectively. The supportive elongated bar 23 connects the second track 27 to the seat panel 1. The third elongated bar 19 and the fourth elongated bar 20 allows the footrest panel 18 to freely traverse along the first track 26 and the second track 27 as the third elongated bar 19 laterally traverses across the footrest panel 18, and the fourth elongated bar 20 laterally traverses across the footrest panel 18, opposite the third elongated bar 19. More specifically, the third elongated bar 19 is oriented parallel with the fourth elongated bar 20. The second track 27 is positioned adjacent the retractable footrest 17 as the supportive elongated bar 23 is positioned in between and oriented parallel to the second elongated bar 12 of the first frame 5 and the second elongated bar 12 of the second frame 6. More specifically, the supportive elongated bar 23 is mounted to the second surface 3 of the seat panel 1. The retractable footrest 17 retracts into and extends out of the storage receptacle 21 as the first track 26 traverses along the second elongated bar 12 of the second frame 6, and the second track 27 traverses along the supportive elongated bar 23, positioned adjacent the first track 26. Moreover, the third elongated bar 19 slidably engages with the first track 26. Similarly, the fourth elongated bar 20 slidably engages with the second track 27.

The retractable footrest 17 remains connected to the storage receptacle 21, and consequently the rest of the present invention, as the present invention further comprises a third stopper bar 45 and a fourth stopper bar 48, seen in FIG. 1, FIG. 2, FIG. 3, FIG. 4, FIG. 5, and FIG. 6. The third stopper bar 45 prevents the retractable footrest 17 from slipping past the storage receptacle 21 while being retracted within the storage receptacle 21. The fourth stopper bar 48 prevents the retractable footrest 17 from separating from the storage receptacle 21 while being extended through a main opening 22 of the storage receptacle 21. The third stopper bar 45 is terminally positioned with the footrest panel 18, and the fourth stopper bar 48 is positioned adjacent the footrest panel 18, opposite the third stopper bar 45. Moreover, the third stopper bar 45 and the fourth stopper bar 48 is fixed to both and oriented perpendicular with the third elongated bar 19 and the fourth elongated bar 20. In order for the third elongated bar 19 to stop the retractable storage receptacle 21 with the third stopper bar 45 and the fourth stopper bar 48, the third elongated bar 19 is positioned offset a first end 46 of the third stopper bar 45 and a first end 49 of the fourth stopper bar 48. Similarly, the fourth elongated bar 20 stops the retractable storage receptacle 21 with the third stopper bar 45 and the fourth stopper bar 48 as the fourth elongated bar 20 is positioned offset a second end 47 of the third stopper bar 45 and a second end 50 of fourth stopper bar 48. More specifically, the first end 46 of the third stopper bar 45 is positioned opposite the second end 47 of the third stopper bar 45, and the first end 49 of the fourth stopper bar 48 is positioned opposite the second end 50 of the fourth stopper bar 48.

In the preferred embodiment of the present invention, both the storage receptacle 21 and the seat panel 1 is further stabilized as the supportive elongated bar 23 comprises a supporting portion 24 and a leg portion 25, similar to that of the first elongated bar 7 and the second elongated bar 12. As seen in FIG. 4, the supporting portion 24 connects the supportive elongated bar 23 to the seat panel 1 and the second track 27 to the supportive elongated bar 23. The leg portion 25 presses against the ground. More specifically, the supporting portion 24 is fixed to the second surface 3 of the seat panel 1, and the second track 27 traverses along the supporting portion 24. A main opening 22 of the storage receptacle 21 is positioned adjacent the supporting portion 24, and the leg portion 25 is positioned adjacent the supporting portion 24, opposite the main opening 22.

A user is able to manipulate the retractable footrest 17 within the storage receptacle 21 while sitting on the seat panel 1, and resting against the back panel 4, as the slider mechanism 28 comprises a main track 29, a handle 31, a cable 32, a first pulley 35, a second pulley 36, a third pulley 37, a first elongated brace 39 and a second elongated brace 40, seen in FIG. 4. The main track 29 positions and guides the handle 31. The cable 32 connects the handle 31 to the at retractable footrest 17. The first pulley 35, the second pulley 36, the third pulley 37, and the fourth pulley 38 guide and direct the cable 32 as well as allow the cable 32 to freely move. The first elongated brace 39 and the second elongated brace 40 position the first pulley 35 and the second pulley 36 with the main track 29 and position the main track 29 adjacent the second frame 6 without inhibiting the retraction and the extension of the retractable footrest 17 within the storage receptacle 21.

The overall configuration of the slider mechanism 28 allows a user to retract and extend the retractable footrest 17 with the handle 31. As seen in FIG. 3 and FIG. 4, the first elongated brace 39 is positioned adjacent the third end 15 of the second elongated bar 12. Similarly, the second elongated brace 40 is positioned adjacent the fourth end 16 of the second elongated bar 12. Moreover, the first elongated brace 39 and the second elongated brace 40 are connected to both the second elongated bar 12 of the second frame 6 and the supportive elongated bar 23. The cable 32 smoothly traverses along the main track 29 as the main track 29 is terminally mounted to the first elongated brace 39 with the first pulley 35 and is mounted to the second elongated brace 40 with the second pulley 36. The cable 32 is continuously connected from the handle 31 to the retractable footrest 17 as the third pulley 37 is positioned opposite the first pulley 35 across the first elongated brace 39 and is mounted to the first elongated brace 39, opposite the supportive. Similarly, the fourth pulley 38 is positioned opposite the second pulley 36 across the second elongated brace 40 and is mounted to the second elongated brace 40, opposite the supportive elongated bar 23. Moreover, the cable 32 traverses along the main track 29, through each spool of the first pulley 35, the second pulley 36, the third pulley 37, and the fourth pulley 38, and handle 31 traverses through a slot 30 of the main track 29. The slot 30 is oriented away from the second frame 6 so that the handle 31 freely moves along the main track 29. The linear path of the handle 31 manipulates retraction and the extension of the retractable footrest 17 as a first end 33 of the cable 32 is fixed to the handle 31, and a second end 34 of the cable 32 is connected to the fourth elongated bar 20 of the retractable footrest 17.

Although the invention has been explained in relation to its preferred embodiment, it is to be understood that many other possible modifications and variations can be made without departing from the spirit and scope of the invention as hereinafter claimed.

What is claimed is:

1. A bench with a retractable footrest comprises:
- a seat panel;
- a back panel;
- a first frame;
- a second frame;
- a retractable footrest;
- a storage receptacle;
- a slider mechanism;
- the first frame and the second frame each comprises a first elongated bar and a second elongated bar;
- the seat panel being positioned adjacent the back panel;
- the seat panel being connected in between the second elongated bar of the first frame and the second elongated bar of the second frame;
- the back panel being connected in between the first elongated bar of the first frame and the first elongated bar of the second frame;
- the first elongated bar and the second elongated bar being hingedly coupled at a rotational central axis;
- the storage receptacle traversing across a second surface of the seat panel;
- the second surface being positioned opposite a first surface of the seat panel, across the seat panel;
- the storage receptacle being mounted to the second elongated bar of the second frame and the second surface of the seat panel;
- the slider mechanism being operatively coupled with the retractable footrest and the storage receptacle, wherein the slider mechanism enables the retractable footrest to slide into and out of the storage receptacle;
- a first stopper bar;
- a second stopper bar;
- the rotational central axis being positioned in between a first end and a second end of the first elongated bar;
- the first stopper bar and the second stopper bar traversing from the first frame to the second frame;
- the first stopper bar and the second stopper bar being fixed to the first elongated bar of the first frame and the first elongated bar of the second frame;
- the first stopper bar being positioned between the rotational central axis and the second end; and
- the second stopper bar being positioned between the rotational central axis and the first end.

2. The bench with a retractable footrest as claimed in claim 1 comprises:
- the first elongated bar comprises a first panel-supporting portion and a first leg portion;
- the second elongated bar comprises a second panel-supporting portion and a second leg portion;
- the first panel-supporting portion being positioned adjacent a first end of the first elongated bar;
- the first leg portion being positioned adjacent a second end of the first elongated bar;
- the first end being positioned opposite the second end of the first elongated bar;

the second panel-supporting portion being positioned adjacent a third end of the second elongated bar;

the second leg portion being positioned adjacent a fourth end of the second elongated bar;

the third end being positioned opposite the fourth end of the second elongated bar; and, the rotational central axis traversing through the first elongated bar, between the first panel-supporting portion and the first leg portion, and the second elongated bar, between the second panel-supporting portion and the second leg portion.

3. The bench with a retractable footrest as claimed in claim 1 comprises:

an armrest;

the first elongated bar of the second frame being terminally fixed to the armrest; and, the armrest being oriented towards the seat panel.

4. The bench with a retractable footrest as claimed in claim 1 comprises:

the retractable footrest comprises a footrest panel, a third elongated bar, and a fourth elongated bar;

the storage receptacle comprises a supportive elongated bar, a first track, and a second track;

the third elongated bar laterally traversing across the footrest panel;

the third elongated bar oriented parallel with the fourth elongated bar;

the fourth elongated bar laterally traversing across the footrest panel, opposite the third elongated bar;

the supportive elongated bar being positioned in between and oriented parallel to the second elongated bar of the first frame and the second elongated bar of the second frame;

the supportive elongated bar being mounted to the second surface of the seat panel;

the first track traversing along the second elongated bar of the second frame;

the second track traversing along the supportive elongated bar, positioned adjacent the first track;

the third elongated bar being slidably engaged with the first track; and, the fourth elongated bar being slidably engaged with the second track.

5. The bench with a retractable footrest as claimed in claim 4 comprises:

the slider mechanism comprises a main track, a handle, a cable, a first pulley, a second pulley, a third pulley, a fourth pulley, a first elongated brace, and a second elongated brace;

the first elongated brace being positioned adjacent the third end of the second elongated bar;

the second elongated brace being positioned adjacent the fourth end of the second elongated bar;

the first elongated brace and the second elongated brace being connected to both the second elongated bar of the second frame and the supportive elongated bar;

the main track being terminally mounted to the first elongated brace with the first pulley;

the main track being terminally mounted to the second elongated brace with the second pulley;

the third pulley being positioned opposite the first pulley across the first elongated brace;

the third pulley being mounted to the first elongated brace, opposite the supportive elongated bar;

the fourth pulley being positioned opposite the second pulley across the second elongated brace;

the fourth pulley being mounted to the second elongated brace, opposite the supportive elongated bar;

the cable traversing along the main track, through each spool of the first pulley, the second pulley, the third pulley, and the fourth pulley;

the handle traversing through a slot of the main track;

the slot being oriented away from the second frame;

a first end of the cable being fixed to the handle; and, a second end of the cable being connected to the fourth elongated bar of the retractable footrest.

6. The bench with a retractable footrest as claimed in claim 4 comprises:

a third stopper bar;

a fourth stopper bar;

the third stopper bar being terminally positioned with the footrest panel;

the fourth stopper bar being positioned adjacent the footrest panel, opposite the third stopper bar;

the third stopper bar and the fourth stopper bar being fixed to both the third elongated bar and the fourth elongated bar;

the third stopper and the fourth stopper bar being oriented perpendicular with the third elongated bar and the fourth elongated bar;

the third elongated bar being positioned offset a first end of the third stopper bar and a first end of the fourth stopper bar;

the fourth elongated bar being positioned offset a second end of the third stopper bar and a second end of the fourth stopper bar;

the first end of the third stopper bar being positioned opposite the second end of the third stopper bar; and, the first end of the fourth stopper bar being positioned opposite the second end of the fourth stopper bar.

7. The bench with a retractable footrest as claimed in claim 4 comprises:

the supportive elongated bar comprises a supporting portion and a leg portion;

the supporting portion being fixed to the second surface of the seat panel;

the second track traversing along the supporting portion;

a main opening of the storage receptacle being positioned adjacent the supporting portion; and, the leg portion being positioned adjacent the supporting portion, opposite the main opening.

8. A bench with a retractable footrest comprises:

a seat panel;

a back panel;

a first frame;

a second frame;

a retractable footrest;

a storage receptacle;

a slider mechanism;

the first frame and the second frame each comprises a first elongated bar and a second elongated bar;

the seat panel being positioned adjacent the back panel;

the seat panel being connected in between the second elongated bar of the first frame and the second elongated bar of the second frame;

the back panel being connected in between the first elongated bar of the first frame and the first elongated bar of the second frame;

the first elongated bar and the second elongated bar being hingedly coupled at a rotational central axis;

the storage receptacle traversing across a second surface of the seat panel;

the second surface being positioned opposite a first surface of the seat panel, across the seat panel;

the storage receptacle being mounted to the second elongated bar of the second frame and the second surface of the seat panel; and, the slider mechanism being operatively coupled with the retractable footrest and the storage receptacle, wherein the slider mechanism enables the retractable footrest to slide into and out of the storage receptacle;

a first stopper bar;

a second stopper bar;

the rotational central axis being positioned in between a first end and a second end of the first elongated bar;

the first stopper bar and the second stopper bar traversing from the first frame to the second frame;

the first stopper bar and the second stopper bar being fixed to the first elongated bar of the first frame and the first elongated bar of the second frame;

the first stopper bar being positioned between the rotational central axis and the second end; and the second stopper bar being positioned between the rotational central axis and the first end.

9. The bench with a retractable footrest as claimed in claim 8 comprises:

an armrest;

the first elongated bar of the second frame being terminally fixed to the armrest; and, the armrest being oriented towards the seat panel.

10. The bench with a retractable footrest as claimed in claim 8 comprises:

the first elongated bar comprises a first panel-supporting portion and a first leg portion;

the second elongated bar comprises a second panel-supporting portion and a second leg portion;

the first panel-supporting portion being positioned adjacent a first end of the first elongated bar;

the first leg portion being positioned adjacent a second end of the first elongated bar;

the first end being positioned opposite the second end of the first elongated bar;

the second panel-supporting portion being positioned adjacent a third end of the second elongated bar;

the second leg portion being positioned adjacent a fourth end of the second elongated bar;

the third end being positioned opposite the fourth end of the second elongated bar; and, the rotational central axis traversing through the first elongated bar, between the first panel-supporting portion and the first leg portion, and the second elongated bar, between the second panel-supporting portion and the second leg portion.

11. The bench with a retractable footrest as claimed in claim 8 comprises:

the retractable footrest comprises a footrest panel, a third elongated bar, and a fourth elongated bar;

the storage receptacle comprises a supportive elongated bar, a first track, and a second track;

the slider mechanism comprises a main track, a handle, a cable, a first pulley, a second pulley, a third pulley, a fourth pulley, a first elongated brace, and a second elongated brace;

the third elongated bar laterally traversing across the footrest panel;

the third elongated bar oriented parallel with the fourth elongated bar;

the fourth elongated bar laterally traversing across the footrest panel, opposite the third elongated bar;

the supportive elongated bar being positioned in between and oriented parallel to the second elongated bar of the first frame and the second elongated bar of the second frame;

the supportive elongated bar being mounted to the second surface of the seat panel;

the first track traversing along the second elongated bar of the second frame;

the second track traversing along the supportive elongated bar, positioned adjacent the first track;

the third elongated bar being slidably engaged with the first track;

the fourth elongated bar being slidably engaged with the second track;

the first elongated brace being positioned adjacent the third end of the second elongated bar;

the second elongated brace being positioned adjacent the fourth end of the second elongated bar;

the first elongated brace and the second elongated brace being connected to both the second elongated bar of the second frame and the supportive elongated bar;

the main track being terminally mounted to the first elongated brace with the first pulley;

the main track being terminally mounted to the second elongated brace with the second pulley;

the third pulley being positioned opposite the first pulley across the first elongated brace;

the third pulley being mounted to the first elongated brace, opposite the supportive elongated bar;

the fourth pulley being positioned opposite the second pulley across the second elongated brace;

the fourth pulley being mounted to the second elongated brace, opposite the supportive elongated bar;

the cable traversing along the main track, through each spool of the first pulley, the second pulley, the third pulley, and the fourth pulley;

the handle traversing through a slot of the main track;

the slot being oriented away from the second frame;

a first end of the cable being fixed to the handle; and, a second end of the cable being connected to the fourth elongated bar of the retractable footrest.

12. The bench with a retractable footrest as claimed in claim 11 comprises:

a third stopper bar;

a fourth stopper bar;

the third stopper bar being terminally positioned with the footrest panel;

the fourth stopper bar being positioned adjacent the footrest panel, opposite the third stopper bar;

the third stopper bar and the fourth stopper bar being fixed to both the third elongated bar and the fourth elongated bar;

the third stopper and the fourth stopper bar being oriented perpendicular with the third elongated bar and the fourth elongated bar;

the third elongated bar being positioned offset a first end of the third stopper bar and a first end of the fourth stopper bar;

the fourth elongated bar being positioned offset a second end of the third stopper bar and a second end of the fourth stopper bar;

the first end of the third stopper bar being positioned opposite the second end of the third stopper bar; and, the first end of the fourth stopper bar being positioned opposite the second end of the fourth stopper bar.

13. The bench with a retractable footrest as claimed in claim 11 comprises:

the supportive elongated bar comprises a supporting portion and a leg portion;

the supporting portion being fixed to the second surface of the seat panel;

the second track traversing along the supporting portion;

a main opening of the storage receptacle being positioned adjacent the supporting portion; and, the leg portion being positioned adjacent the supporting portion, opposite the main opening.

* * * * *